US010024105B2

(12) United States Patent
Wright et al.

(10) Patent No.: US 10,024,105 B2
(45) Date of Patent: Jul. 17, 2018

(54) ROCK BIT

(71) Applicant: Radius HDD Direct LLC, Perry, OK (US)

(72) Inventors: Toby Wright, Fort Worth, TX (US); David Bullock, Weatherford, TX (US)

(73) Assignee: Radius HDD Direct, LLC, Perry, OK (US)

( * ) Notice: Subject to any disclaimer, the term of this patent is extended or adjusted under 35 U.S.C. 154(b) by 283 days.

(21) Appl. No.: 15/050,019

(22) Filed: Feb. 22, 2016

(65) Prior Publication Data

US 2016/0245023 A1 Aug. 25, 2016

Related U.S. Application Data

(60) Provisional application No. 62/120,648, filed on Feb. 25, 2015.

(51) Int. Cl.

| | |
|---|---|
| ***E21B 7/06*** | (2006.01) |
| ***E21B 7/04*** | (2006.01) |
| ***E21B 10/55*** | (2006.01) |
| ***E21B 10/62*** | (2006.01) |
| ***E21B 17/10*** | (2006.01) |

(52) U.S. Cl.

CPC ..... *E21B 7/064* (2013.01); *E21B 7/046* (2013.01); *E21B 10/55* (2013.01); *E21B 10/62* (2013.01); *E21B 17/1092* (2013.01)

(58) Field of Classification Search

CPC ..... E21B 10/42; E21B 10/55; E21B 627/046; E21B 627/064

USPC ..... 175/398

See application file for complete search history.

(56) References Cited

U.S. PATENT DOCUMENTS

| | | | | |
|---|---|---|---|---|
| 4,499,958 | A * | 2/1985 | Radtke | E21B 10/55 175/428 |
| 4,911,579 | A | 3/1990 | Lutz et al. | |
| 5,033,907 | A | 7/1991 | O'Donnell et al. | |
| 5,778,991 | A | 7/1998 | Rundquist et al. | |
| 5,931,240 | A * | 8/1999 | Cox | E21B 7/06 175/398 |
| 5,941,322 | A * | 8/1999 | Stephenson | E21B 7/06 175/376 |
| 6,250,404 | B1 * | 6/2001 | Gunsaulis | E21B 7/064 175/62 |
| 6,260,634 | B1 | 7/2001 | Wentworth et al. | |
| 6,321,858 | B1 * | 11/2001 | Wentworth | E21B 7/064 175/365 |
| 6,394,200 | B1 * | 5/2002 | Watson | E21B 7/067 175/385 |

(Continued)

FOREIGN PATENT DOCUMENTS

| | | | | |
|---|---|---|---|---|
| CN | 102226376 A * | 10/2011 | | E21B 10/62 |
| DE | 20310467 U1 * | 9/2003 | | E21B 7/064 |

*Primary Examiner* — Jennifer H Gay

(74) *Attorney, Agent, or Firm* — Tomlinson McKinstry, P.C.

(57) ABSTRACT

A steerable rock bit attached by a drill string to a horizontal directional drill. The bit comprises a plurality of flanges radially extending from a central hub and a slanted face formed in the body of the bit. Cutting elements such as polycrystalline diamond compacts are disposed on the flanges on one side of the flanges such that they will provide cutting force when the bit is rotated in the direction of the cutting elements. The bit is advanced generally straight when the bit is rotated and is advanced at an angle away from the slanted face when the bit is not rotated.

20 Claims, 5 Drawing Sheets

(56) References Cited

U.S. PATENT DOCUMENTS

| | | | | |
|---|---|---|---|---|
| 6,454,025 | B1 * | 9/2002 | Runquist | E21B 4/14 175/61 |
| 6,588,515 | B2 | 7/2003 | Wentworth et al. | |
| 6,789,635 | B2 * | 9/2004 | Wentworth | E21B 7/046 175/327 |
| 6,827,159 | B2 * | 12/2004 | Sved | E21B 7/046 175/399 |
| 7,976,243 | B2 | 7/2011 | Rohde et al. | |
| 8,122,979 | B1 * | 2/2012 | Wright, Jr. | E21B 10/62 175/398 |
| 2002/0112890 | A1 * | 8/2002 | Wentworth | F16L 55/18 175/57 |
| 2003/0106714 | A1 | 6/2003 | Smith et al. | |
| 2006/0131077 | A1 * | 6/2006 | Tjader | E21B 7/064 175/73 |
| 2006/0196699 | A1 * | 9/2006 | Estes | E21B 10/04 175/374 |
| 2011/0250020 | A1 | 10/2011 | Carter et al. | |
| 2012/0006597 | A1 * | 1/2012 | Boike | E21B 7/046 175/45 |
| 2014/0131111 | A1 * | 5/2014 | Desmette | E21B 10/26 175/57 |
| 2014/0338982 | A1 * | 11/2014 | Wright, Jr. | E21B 7/046 175/73 |
| 2015/0226007 | A1 * | 8/2015 | Harrington | E21B 10/18 175/340 |
| 2015/0233183 | A1 * | 8/2015 | Melsheimer | E21B 10/602 175/45 |
| 2016/0245023 | A1 * | 8/2016 | Wright | E21B 10/62 |
| 2017/0044647 | A1 * | 2/2017 | Olsen | C22C 32/00 |
| 2017/0284192 | A1 * | 10/2017 | Melsheimer | E21B 10/602 |

* cited by examiner

ROCK BIT

CROSS REFERENCE TO RELATED APPLICATION

This application claims the benefit of provisional patent application Ser. No. 62/120,648 filed on Feb. 25, 2015, the entire contents of which are incorporated herein by reference.

FIELD

This invention relates generally to steerable bits for utility installation.

BACKGROUND

Horizontal Directional Drilling (HDD) is a construction alternative to open trenching for installation of underground utilities, conduit and pipelines. HDD is particularly useful for installing utilities or conduit in areas where open trenching would be impractical due to natural features or existing infrastructure. By using a steerable pilot tool, HDD allows the operator to drill a bore path that avoids existing features in the project area.

Many underground installation projects occur in areas with congested easements or space limitations that require smaller bore paths. When bore paths become smaller due to space considerations and project complexity, the need for responsive and accurate pilot tools increases.

Additionally, HDD projects occur in a variety of ground conditions from hard compacted soils to various loose and solid rock formations. In addition to being responsive and accurate in steering, it is desirable for a pilot tool to be capable of drilling through various ground conditions. Therefore, there is a need for a steerable rock bit that is accurate and responsive and that can drill effectively through hard various soil conditions, including solid rock.

SUMMARY

The present invention is directed to a bit. The bit comprises a body, a plurality of projecting flanges, and a plurality of cutting elements. The body has a threaded connector. The threaded connector is symmetric about a longitudinal axis. The body additionally has a hub situated on the longitudinal axis and is shaped asymmetrically with respect to the longitudinal axis. The plurality of projecting flanges are supported by the body and extend radially from the hub. Each flange is characterized by a pair of spaced sides. The plurality of cutting elements is supported on only one side of each flange.

In another embodiment the present invention is directed to a bit. The bit comprises a body, a plurality of projecting flanges supported by the body, a slanted face disposed on a portion of the body having no flanges, and a plurality of cutting elements. The body has a hub situated on a longitudinal axis. The plurality of flanges extend from the hub and are characterized by a pair of spaced sides. The plurality of cutting elements are supported on each flange and installed on the side of each flange that would lead if the hub were rotated about the longitudinal axis in a single selected direction.

DETAILED DESCRIPTION

Figure 1:
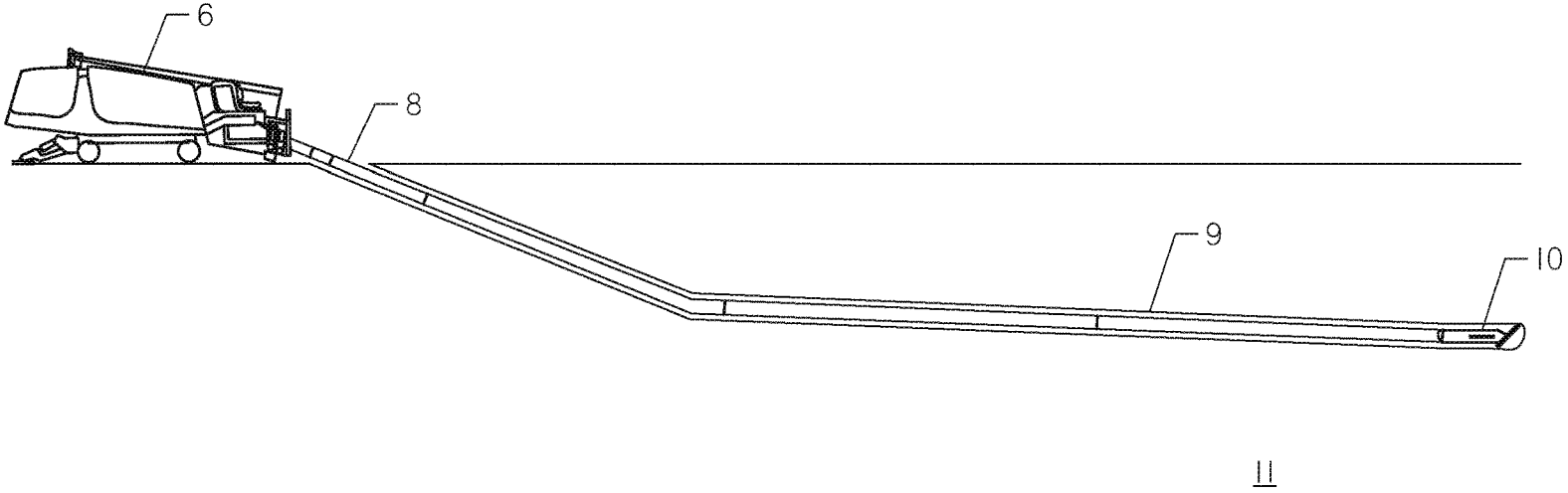
FIG. 1 is a diagrammatic representation of a system for horizontal directional drilling using the rock bit of the present invention.

With reference now to the figures in general, and FIG. 1 in particular, shown therein is a horizontal directional drill (HDD) 6 for use with the current invention. The drill 6 rotates and advances a drill string 8 with a drill bit 10 attached to a distal end of the drill string to create a borehole 9 in the subsurface 11.

Figure 2:
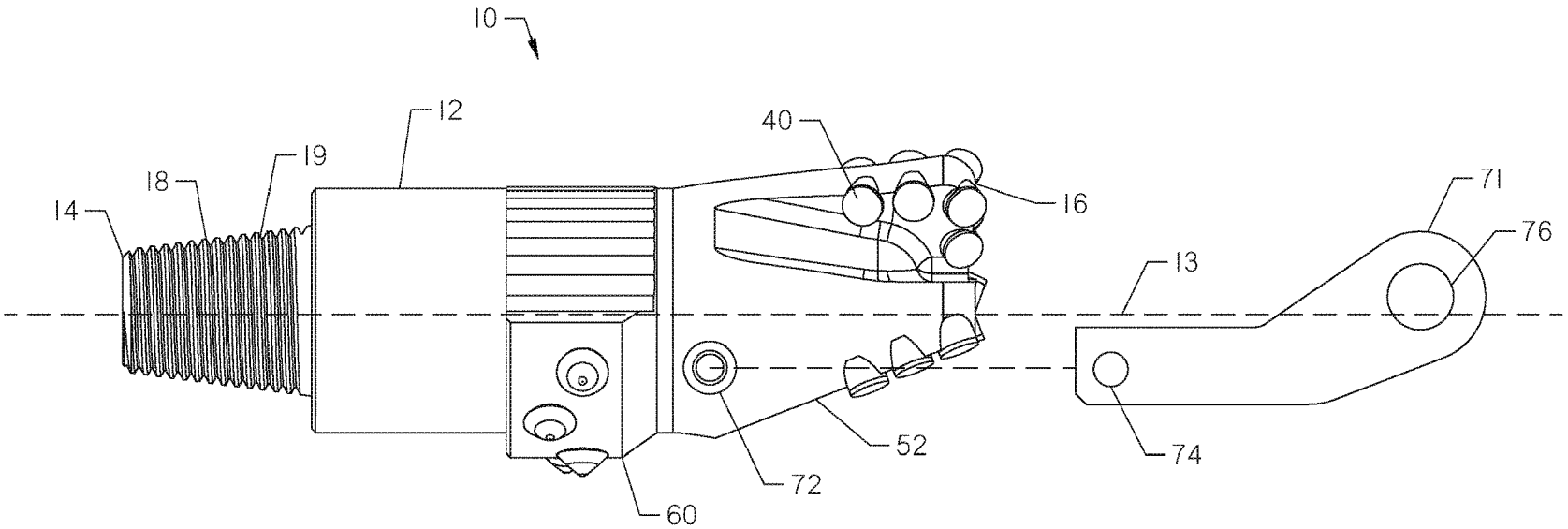
FIG. 2 is a side view of the steerable rock bit of the present invention.

With reference to FIG. 2, shown therein is the rock bit 10 for drilling a bore hole in HDD operations. The rock bit 10 has an elongate bit body 12 disposed along a longitudinal axis 13. The bit body 12 comprises a first end 14 and a second end 16. The first end 14 has a connection structure 18 for attaching the bit body 12 to a drill string (not shown), either directly or through a transmitter housing (not shown). While the connection structure 18 of FIG. 2 comprises threads 19, splines or other known connection methods may be utilized to connect the rock bit 10 to the drill string without departing from the spirit of the invention. Preferably, the connection structure 18 is symmetrical about the longitudinal axis 13. As will be described with more particularity below, a slanted face 52 may be formed in the bit body 12. A pullback adaptor 71 may attach to the bit body 12 at a bolt hole 72.

Figure 3:
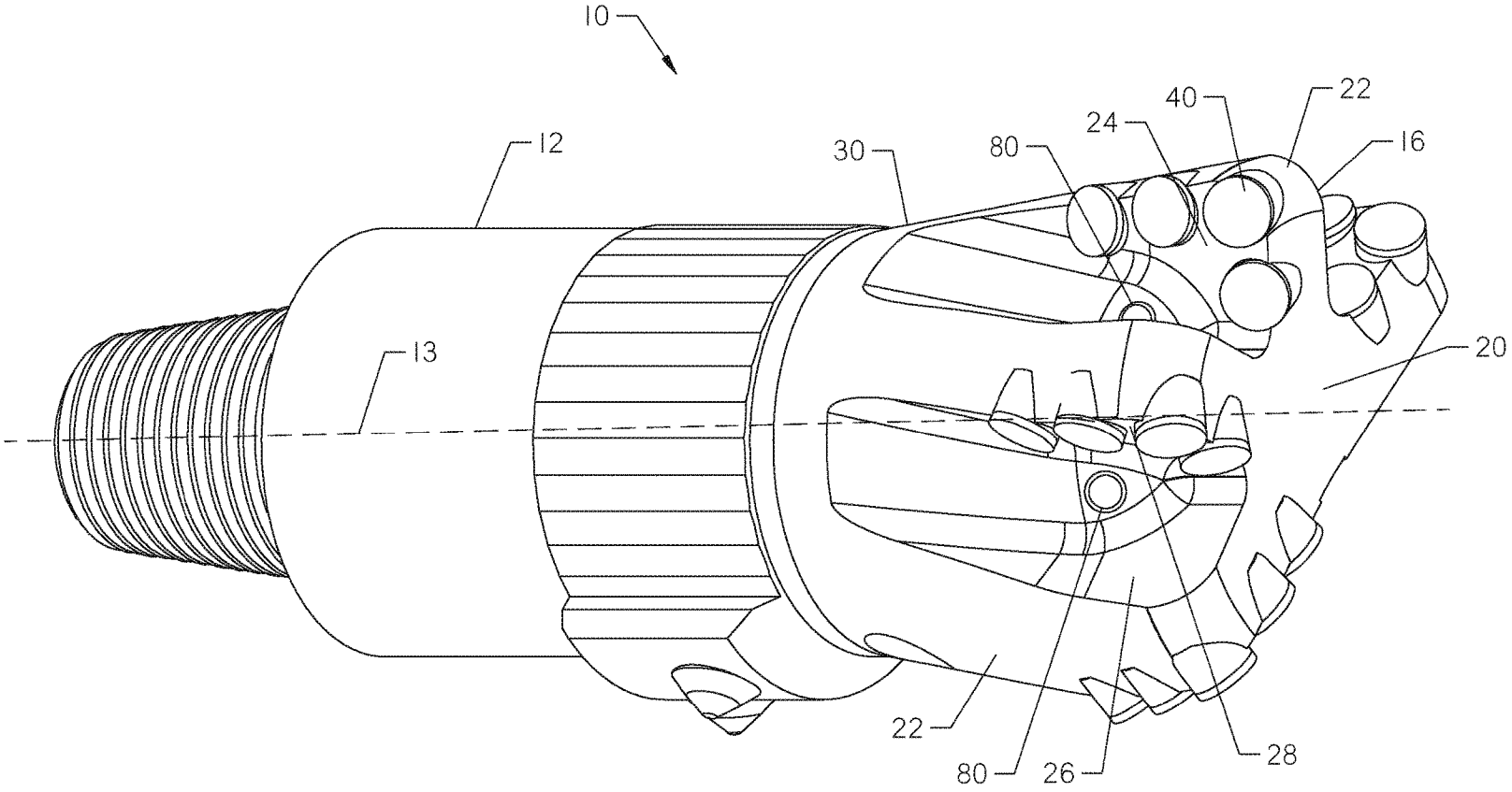
FIG. 3 is a top perspective view of the steerable rock bit of FIG. 2.

With reference to FIG. 3, the bit body 12 comprises a central hub 20 and a plurality of flanges 22. The central hub 20 is generally disposed about the longitudinal axis 13. Each of the flanges 22 extends from the central hub 20 and is defined by a first face 24, a second face 26, a leading edge 28 and a trailing edge 30. Preferably, the first face 24 and the second face 26 are spaced apart to provide a thickness for the flanges 22. As shown, the first face 24 and second face 26 are generally parallel. A plurality of cutters 40 are disposed on the first face 24 of each of the plurality of flanges 22. Preferably, the cutters 40 are disposed on only one face of each flange 22, such as the first face 24. The first face 24 is the face of each flange 22 that is disposed on the leading side of the flange 22 when the rock bit 10 undergoes rotation. When the bit 10 is viewed from a forward position, as shown in FIG. 3, the first face 24 of each flange 22 faces in a counter-clockwise direction. This positioning allows the cutters 40 to lead when the bit 10 is rotated in a counter-clockwise direction. Preferably, the bit 10 is rotated in only a single selected direction, such as the counter-clockwise direction. As shown, each of the flanges 22 extends radially from the central hub 20, though curved or angled flanges 22 may likewise be used. As shown, there are four flanges 22 extending from the central hub, though other numbers of flanges, such as two to six, may be utilized. The flanges 22 extend, at least partially, outside the radius of the bit body 12.

The cutters 40 are preferably polycrystalline diamond compact (PDC) inserts, which are generally cylindrical in shape and disposed on the first face 24 of the flanges 22. As shown, the leading edge 28 of the plurality of flanges 22 is even with an edge of one of the plurality of cutters 40 such that the cutters engage rock and soil during rotation of the rock bit 10. Cutters 40 may additionally be utilized at the trailing edge 30 of each of the flanges 22. As shown, each flange 22 supports up to four cutters 40, though other numbers of cutters may be utilized per flange. Additionally, cutters 40 may be placed on the second face 26 of the flanges 22 to provide some cutting ability to the rock bit 10 in application where rotation in other than the primary direction of rotation of the rock bit is desired.

Fluid ports 80 may be provided in the second end 16 of the bit body 12. The fluid ports 80 convey drilling fluid from the horizontal directional drill 6 (FIG. 1) to the rock bit 10 through centrally disposed conduits (not shown) within the bit body 12. Fluid may loosen or soften the existing subsurface 11 to help the cutters 40 drill.

Figure 4:
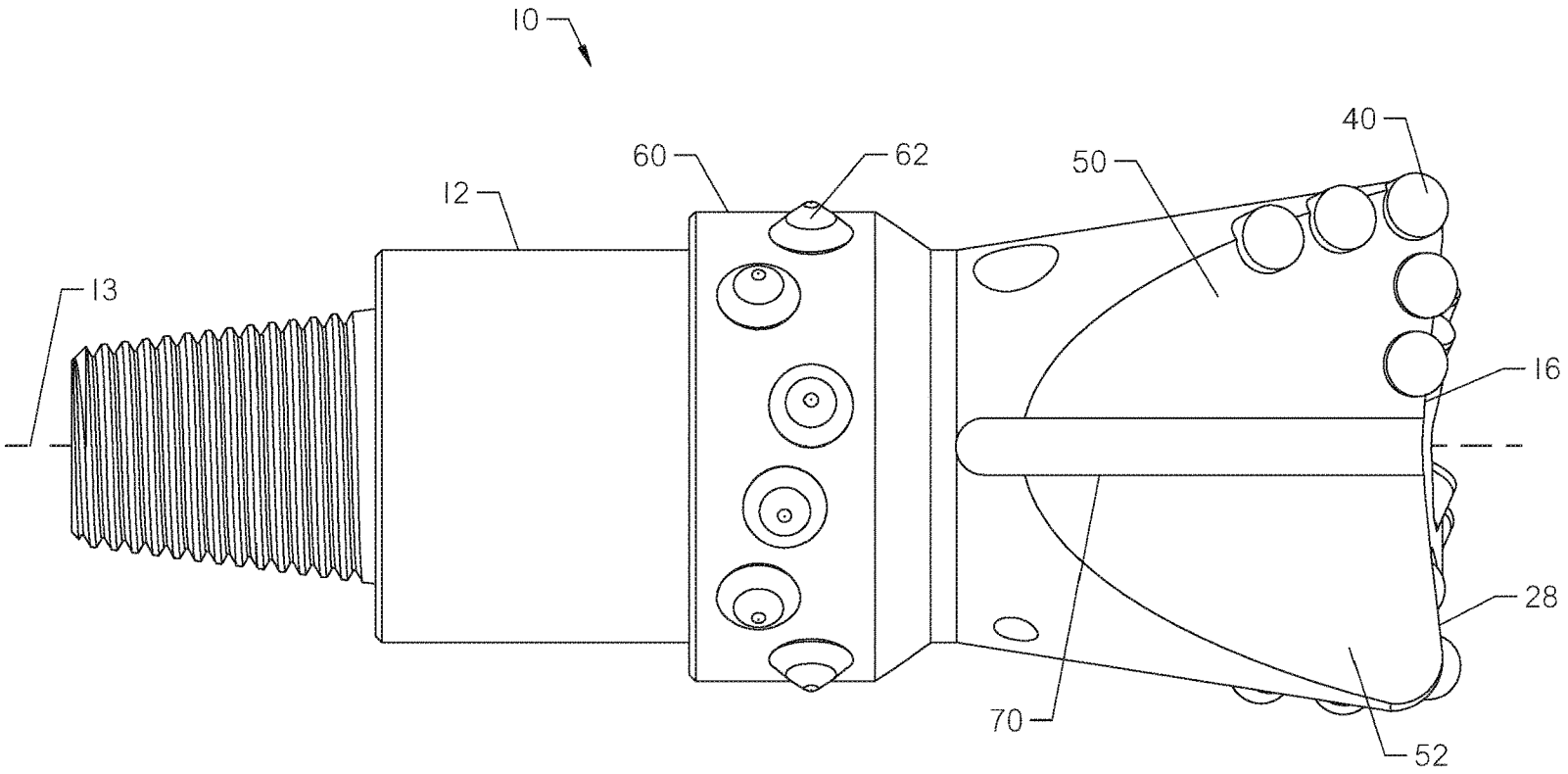
FIG. 4 is a bottom view of the steerable rock bit of FIG. 2.
Figure 5:
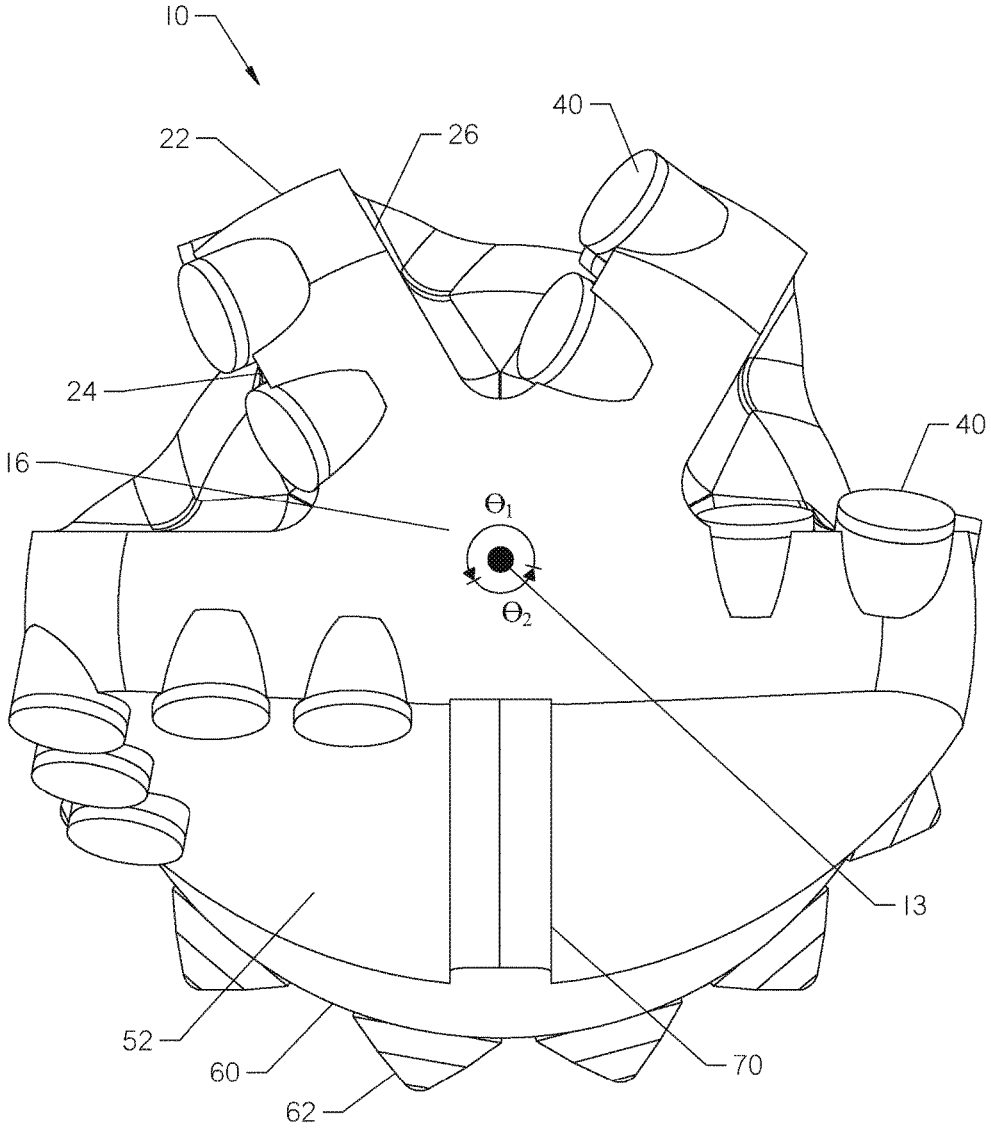
FIG. 5 is an end view of the second end of the steerable rock bit of FIG. 2.

With reference now to FIG. 4, the bit body 12 further comprises a steering feature 50 formed at the second end 16 of the bit body. As shown, the steering feature 50 is a slanted face 52 disposed on a portion of bit body 12 and oriented obliquely to the longitudinal axis 13 of the bit body. Other steering features 50 that impart an asymmetrical shape to the body 12 with respect to the longitudinal axis 13 may be used in lieu of, or in combination with, the slanted face 52. These include gage towers, wear pads, bent shaping of the body 12, non-planar faces, and the like. The slanted face 52 is located on a portion of the bit body 12 that does not have flanges 22 protruding from the central hub. As shown in FIG. 5, the steering feature 50 is contained within a central angle $\theta_2$ about the axis 13 having a size of less than about one hundred eighty degrees and more than about ninety degrees. In one embodiment, the central angle $\theta_2$ is about 140 degrees. The flanges 22 are disposed on the remainder of the bit body 12 not occupied by the steering feature 50. In one embodiment, the flanges 22 are contained within a central angle $\theta_1$ about the axis 13 having a size about 220 degrees.

With reference to FIGS. 4 and 5, the bit body 12 comprises a wear pad 60 located in line with the steering feature 50 of the bit body. The wear pad 60 is a generally raised, hardened pad. The wear pad 60 may comprise carbides 62 for additional hardness. The carbides 62 may crush soil dislodged by the cutters 40 further before they are carried uphole. In typical HDD operations, a steerable bit such as the rock bit 10 will deflect in a direction away from the slanted face 52 when the rock bit is not rotating. During deflection, portions of the bit body 12 on the side of the slanted face 52 will increase their exposure to soil and rock within the subsurface 11 (FIG. 1). The wear pad 60 protects the bit body 12 from damage associated with such exposure. Additionally, the wear pad 60 may provide additional deflection to help the bit 10 turn when the bit is not rotated.

The bit body 12 defines a slot 70 for placement of a pullback adaptor 71 (FIG. 2). The pullback adaptor 71 utilized may be of the type described in U.S. Pat. No. 8,122,979, issued to Wright, et. al. ("Wright"), the contents of which are incorporated herein by reference. The pullback adaptor 71 comprises an attachment aperture 74 and a pullback eye 76. The slot 70 of the present invention, and of Wright, is centrally formed in the slanted face 52 of the rock bit 10. Thus, the slanted face 52 may preferably comprise an adjacent pair of two coplanar surfaces in the embodiment of the figures. With reference again to FIG. 2, an aperture, such as a bolt hole 72, passes through the bit body 12 and the slot 70 for securing the attachment aperture 74 of the pullback adaptor 71 to the bit body 12. The pullback eye 76 may be attached to a pulling mechanism (not shown) such as a tow rope or shackle. Preferably, the pullback eye 76 is centered on the longitudinal axis 13.

In operation, the rock bit 10 advances generally straight through the subsurface 11 when rotated in the direction of the cutters 40 and advanced by the horizontal directional drill 6. The rock bit 10 is deflected in a direction away from the slanted face 52 and wear pad 60 when advanced by the drill 6 without rotation.

Various modifications can be made in the design and operation of the present invention without departing from its spirit. Thus, while the preferred construction and modes of operation of the invention have been explained in what is now considered to represent its best embodiments, it should be understood that within the scope of the appended claims, the invention may be practiced otherwise than as specifically illustrated and described.

What is claimed is:

1. A bit comprising:

a body comprising:

a connection structure, the connection structure symmetric about a longitudinal axis;

a hub situated on the longitudinal axis;

wherein the hub is shaped asymmetrically about the longitudinal axis;

a slot disposed within the hub for connection between the body and a pullback adapter;

a plurality of projecting flanges extending radially from the hub, each flange characterized by a pair of spaced sides; and a plurality of cutting elements supported on each flange, on only one side thereof.

2. The bit of claim 1 in which at least a portion of each flange extends outside the cross-sectional profile of the body at the hub.

3. The bit of claim 1 in which the flanges extend from a sector of the hub defined by a central angle of about 220 degrees, measured about the longitudinal axis.

4. The bit of claim 1 further comprising:

at least one fluid output port formed in an exterior surface of the body between an adjacent pair of flanges; and at least one longitudinal channel extending through the body to the port.

5. The bit of claim 1 wherein the cutting elements comprise polycrystalline diamond compact cutters.

6. The bit of claim 1 further comprising a steering feature disposed on the body.

7. The bit of claim 6 wherein the steering feature comprises one or more surfaces of the body that extend in oblique relationship to the longitudinal axis.

8. The bit of claim 7 wherein the one or more surfaces comprise two coplanar surfaces.

9. The bit of claim 6 wherein the steering feature comprises a slanted face relative to the longitudinal axis and situated within an unflanged sector of the hub defined by a central angle of greater than 90 degrees and less than 180 degrees, measured about the longitudinal axis.

10. The bit of claim 1 wherein the cutting elements are installed on the side of each flange that leads when the hub is rotated about the longitudinal axis in a single selected direction.

11. A method for using the bit of claim 1 comprising:

attaching the bit to a drill string;

positioning the bit such that the bit contacts a sub-surface of the ground;

rotating the drill string to drill a borehole in a first direction; and pushing the drill string without rotation to steer the drill bit in a direction that diverges from the first direction.

12. A system comprising:

a drill string having a first end and a second end, at least a portion of the drill string situated within an underground environment;

a horizontal directional drilling machine engaged to the first end of the drill string; and the bit of claim 1 engaged to the second end of the drill string.

13. The system of claim 12 in which the underground environment is characterized by rocky conditions.

14. A method for using the system of claim 12 comprising:

rotating the drill string to drill a borehole in a first direction; and pushing the drill string without rotation to steer the drill bit in a direction that diverges from the first direction.

15. A bit comprising:

a body having a hub situated on a longitudinal axis;

a plurality of projecting flanges extending from the hub, each flange characterized by a pair of spaced sides;

a steering feature disposed on a portion of the hub having no flanges, in which the steering feature imparts an asymmetrical shape to the hub; and a plurality of cutting elements supported on each flange.

16. The bit of claim 15 in which the plurality of flanges and the hub are formed as a single piece.

17. The bit of claim 15 in which no flange extends past a forward end of the hub.

18. The bit of claim 15 in a fluid port is formed in the hub between at least one adjacent pair of the plurality of flanges.

19. The bit of claim 15 wherein the steering feature comprises a slanted face relative to the longitudinal axis and situated within a sector of the hub defined by a central angle of greater than go degrees and less than 180 degrees, measured about the longitudinal axis.

20. The bit of claim 19 further comprising a slot disposed in the slanted face for connection between the body and a pullback adaptor.

* * * * *